US007849571B2

(12) United States Patent
Chen

(10) Patent No.: US 7,849,571 B2
(45) Date of Patent: Dec. 14, 2010

(54) BUCKLE DEVICE

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 861 days.

(21) Appl. No.: 11/727,539

(22) Filed: Mar. 27, 2007

(65) Prior Publication Data

US 2008/0028579 A1 Feb. 7, 2008

(30) Foreign Application Priority Data

Aug. 4, 2006 (CN) ..... 2006 2 0131101 U

(51) Int. Cl.
*A44B 11/25* (2006.01)

(52) U.S. Cl. ..... 24/625; 24/630; 24/579.11; 24/614; 24/632

(58) Field of Classification Search ..... 24/579.11, 24/614, 615, 616, 625, 630, 632, 662
See application file for complete search history.

(56) References Cited

U.S. PATENT DOCUMENTS

| | | | | |
|---|---|---|---|---|
| 5,604,964 | A * | 2/1997 | Aoshima | 24/632 |
| 5,709,014 | A * | 1/1998 | Takahashi | 24/614 |
| 6,170,133 | B1 * | 1/2001 | Uehara | 24/614 |
| 6,408,494 | B1 * | 6/2002 | Anscher | 24/625 |
| 6,543,101 | B2 * | 4/2003 | Sack et al. | 24/633 |
| 6,711,790 | B2 * | 3/2004 | Pontaoe | 24/633 |
| 2002/0007539 | A1 | 1/2002 | Sack et al. | |
| 2002/0017012 | A1 | 2/2002 | Sack et al. | |

FOREIGN PATENT DOCUMENTS

| | | |
|---|---|---|
| EP | 0943253 A2 | 9/1999 |
| EP | 1129635 A1 | 9/2001 |
| GB | 2295198 A | 5/1996 |

* cited by examiner

*Primary Examiner*—Robert J Sandy
(74) *Attorney, Agent, or Firm*—Bacon & Thomas, PLLC

(57) ABSTRACT

The present invention relates to a buckle device used in child seats of a baby carriage or high chair, comprising first and second waist-strap adjusting device, first and second plug for waist-strap, first and second shoulder strap-coupling device, a socket and a release button. Each of the first and second plugs for waist-strap includes a arm that can be inserted into the socket. Each of the plugs has, in between the arms, a resilient tongue that can be inserted into the socket. The socket has a hole for receiving the release button, and has resilient legs at the bottom thereof so that the release button may maintain in position. The release button includes cavities at both sides thereof for receiving the arms. The release button further includes inclined surfaces corresponding to the resilient tongue between the cavities. When the release button is pressed, the inclined surfaces will exert a force on the resilient tongue to eject the plug from the socket.

16 Claims, 5 Drawing Sheets

BUCKLE DEVICE

FIELD OF THE INVENTION

The present invention relates generally to a buckle device used in child seats of a baby carriage or high chair.

BACKGROUND OF THE INVENTION

Buckles are well known in the prior art. In an exemplary buckle of the prior art, for example, U.S. Pat. No. 6,711,790, a release button is used to urge the male or plug member to disengage from the female or socket member to achieve unlocking. In some other exemplary buckles of the prior art, for example, U.S. Pat. Nos. 5,709,014 and 6,543,101, such unlocking is achieved by subjecting an inclined plane of the release button to act on the inclined plane of the male or plug member so that the plug is disengaged from the locking position.

Regarding the restoration of the release button in existing prior art, some achieve the object by inserting the tongue of the male or plug member (see for example, U.S. Pat. Appln. No. 20050125970), some by means of the arm of the release button itself (see for example, U.S. Pat. No. 6,543,101), some by the integration of the release button on the female or socket member (see for example, U.S. Pat. No. 5,659,931), and some by the integration of the arm of the release button on the female or socket member (see for example, U.S. Pat. No. 6,170,133).

However, in the above-mentioned prior art, there exist problems such as unreliable, inconvenient in operation, and high manufacturing cost.

SUMMARY OF THE INVENTION

Therefore, it is an object of this invention to overcome the defects found in existing prior art.

According to an embodiment of the present invention, the buckle device comprises first and second waist-strap adjusting device, first and second plugs for waist-strap, first and second shoulder strap-coupling device, a socket and a release button. Each of the plugs for waist-strap has a strap-attaching portion, and first and second arm projecting from the strap-attaching portion and inserting into the socket. Furthermore, a resilient tongue that is disposed between the first and second arm of each plug projects from the strap-attaching portion and is adapted to be inserted into the socket.

The socket has first and second openings at opposite ends. The openings are in communication to and facing each other, so as to receive the arm of the plugs therein. A release button is inserted from a hole provided on the top of the socket. The socket has resilient legs at the bottom thereof so that the release button may maintain in position.

The release button includes first and second engaging member at both sides thereof for receiving first and second arm respectively, when the first and second arm of the plugs insert into the socket through the first and second opening.

The release button further includes inclined surfaces corresponding to the resilient tongue between the cavities. When the release button is pressed, the inclined surfaces will exert a force on the resilient tongue to eject the plug from the socket.

The buckle device of the present invention provides a resilient tongue on the plug to cooperate with the inclined surfaces of the release button to eject the plug from the socket. In the buckle device of the present invention, the resilient legs are integrally provided to the socket to facilitate the restoration of the release button.

The buckle device of the present invention makes use of the cooperation of the afore-mentioned components to accomplish a buckle device that is simple in structure and reliable in function.

BRIEF DESCRIPTION OF THE DRAWINGS

The present invention will now be described with reference to the accompanying drawings illustrating preferred embodiments, in which.

DETAILED DESCRIPTION OF INVENTION

Figure 1:
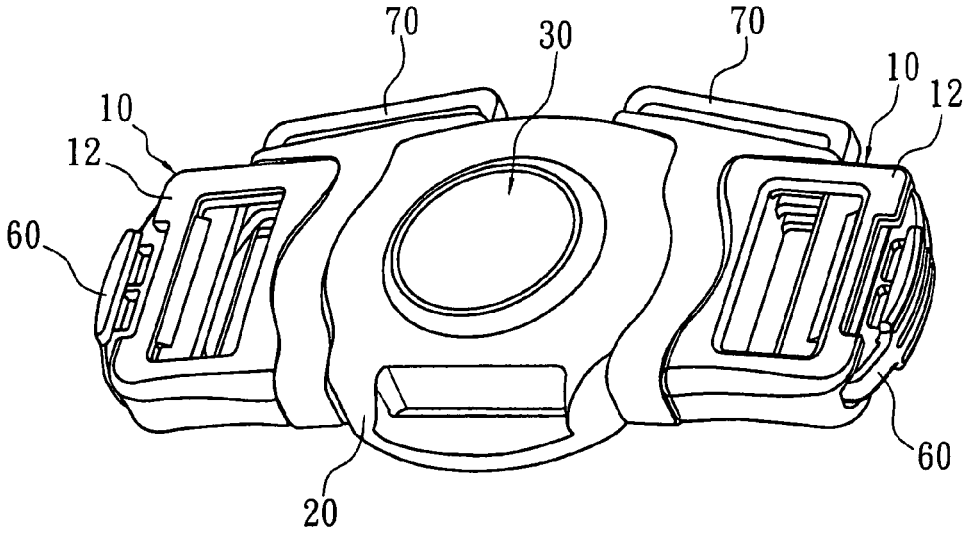
FIG. 1 is a perspective view of the buckle device according to an embodiment of the present invention.
Figure 3:
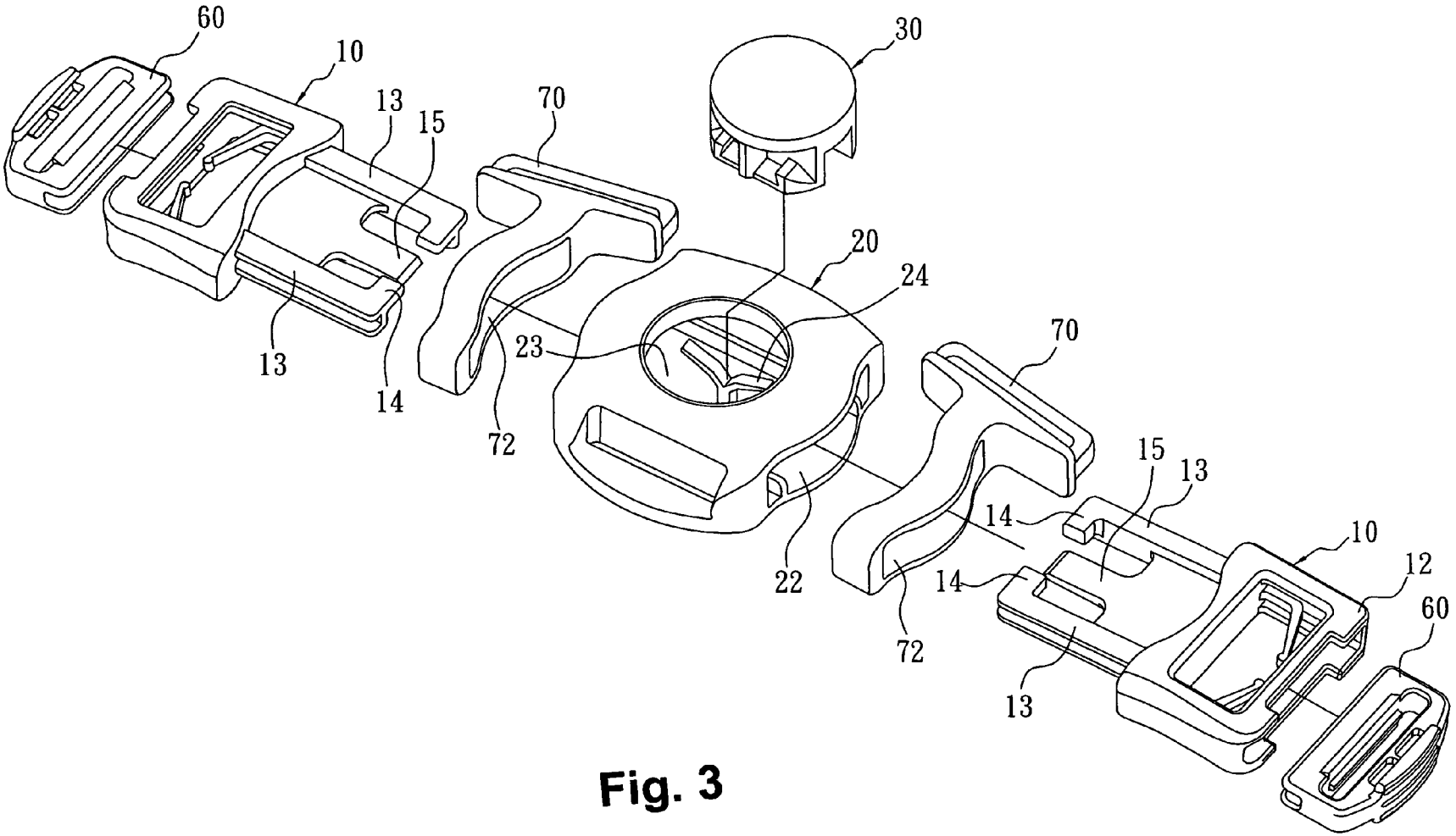
FIG. 3 is an exploded perspective of the buckle device.

A preferred embodiment of this invention will now be described with reference to the accompanying drawings. The buckle device of this embodiment is a buckle suitable for use as a seat belt of a vehicle or a holder for a human body. As shown in FIGS. 1 and 3, the buckle device comprises first and second waist-strap adjusting device 60, first and second plugs for waist-strap (hereinafter first and second plugs) 10, first and second shoulder strap-coupling device 70, a socket 20 and a release button 30.

Each of the plugs 10 has a strap-attaching portion 12 connected to the waist-strap adjusting device 60 at one side, a pair of opposing arms 13 extending from the other side of the strap-attaching portion 12. Each of the arms 13 has an engaging portion 14 disposing at the free end of the arms 13. In this embodiment, the engaging portion 14 is extending lateral perpendicularly to the arm 13 to form a hook shaped. Further, each of the plugs 10 has a resilient tongue 15 projecting from the strap-attaching portion 12 between the first and second arm 13. The arms 13 and the tongue 15 are adapted to be inserted into the socket 20.

Furthermore, first and second shoulder strap-coupling device 70 to attach the shoulder strap are respectively arranged between the first plug 10 and socket 20, and between the second plug 10 and socket 20. Each of the shoulder strap-coupling device 70 includes a slot 72 through which the arm 13 and the resilient tongue 15 of the first and second plug 10 pass to insert into the socket 20.

Figure 2:
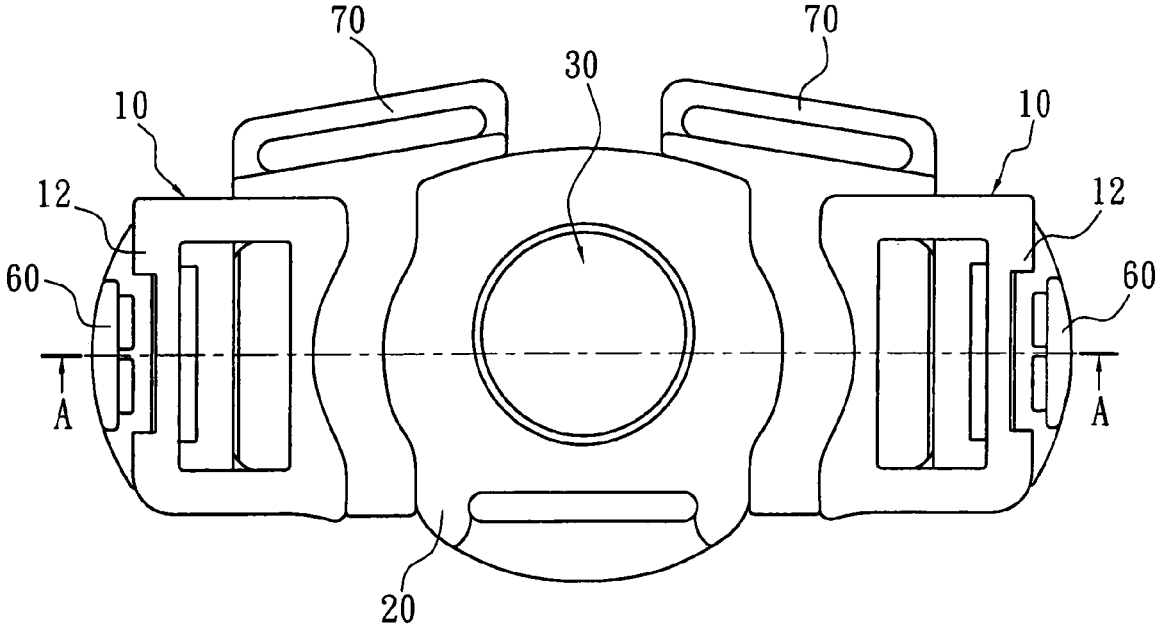
FIG. 2 is a front view of the buckle device shown in FIG. 1, with the plug and socket in a condition of engagement.

The engagement status between the plugs 10, shoulder strap-coupling device 70 and socket 20 can be fully recognized by making reference to FIG. 2.

With reference to FIG. 3, the socket has first and second openings 22 (only one is shown in the figure) at opposite ends. The openings 22 are in communication to and facing each other, so as to receive the first and second arm 13 of the plugs 10 therein.

The socket 20 is provided with a hole 23 on the top for receiving the release button 30 moving within. The socket has a resilient member 24 at the bottom. The function of the resilient member 24 is to maintain the release button in a locking position. In this preferred embodiment, the resilient member 24 is integrally formed on the socket 20 and has two resilient legs substantially in the shape of "Y".

Figure 4:
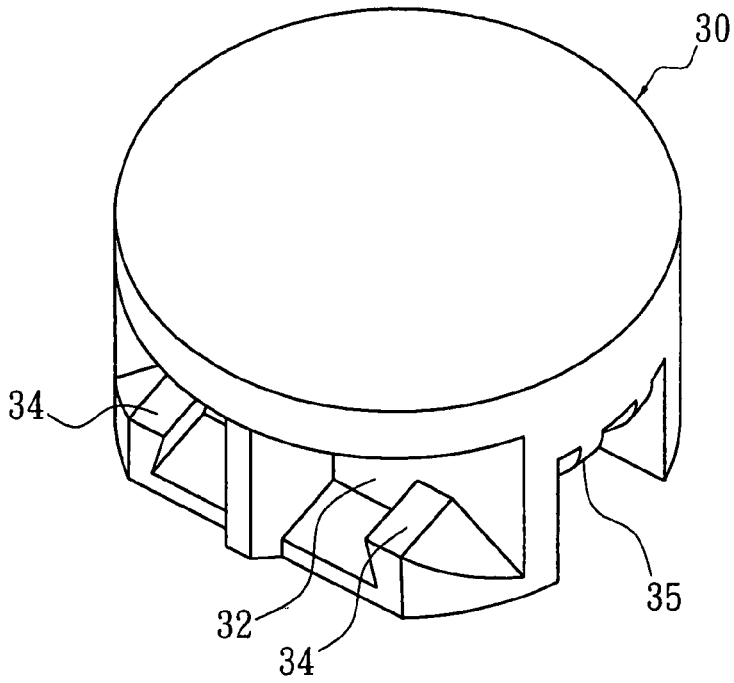
FIG. 4 is a perspective view of the release button of the buckle device.
Figure 5:
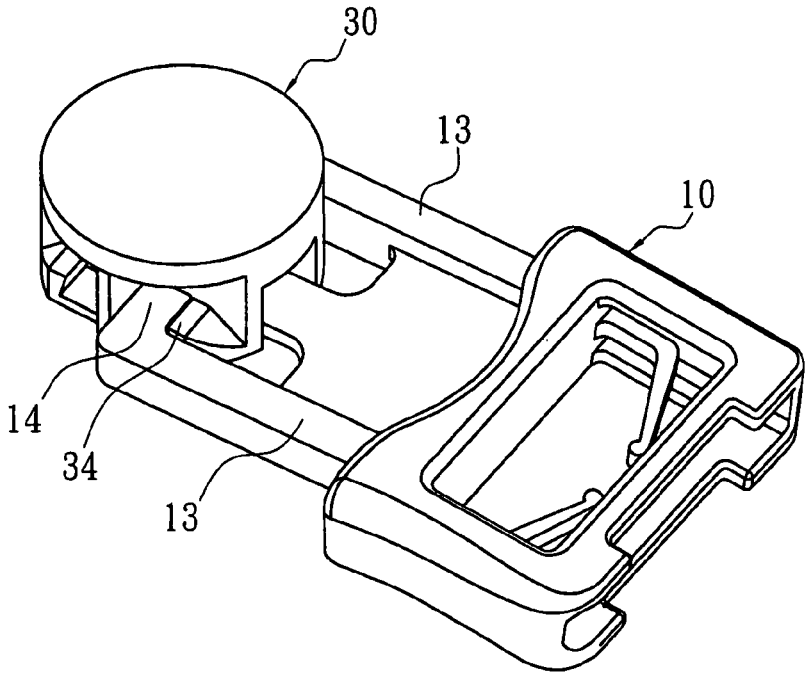
FIG. 5 is a perspective view showing the release button in engagement with one of the plugs.
Figure 6:
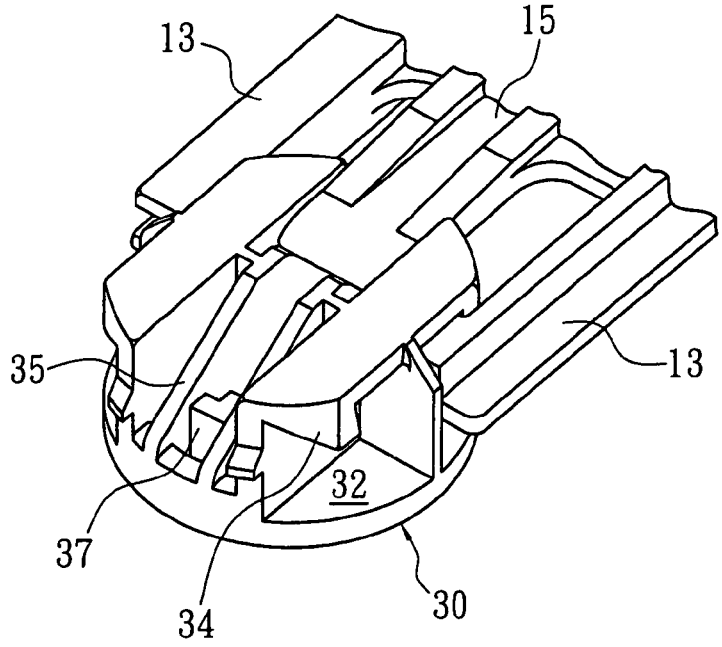
FIG. 6 is similar to FIG. 5, but shows the bottom view of the release button in engagement with the plug.

The detailed structure of the release button 30 can be clearly seen in FIGS. 4 and 6, in which FIG. 4 is a perspective view of the release button, and FIG. 6 illustrates the arrangement after the engagement of the release button 30 and plug 10. FIG. 6 more clearly shows the details of the base portion of the release button 30.

The release button 30 includes first and second engaging members 32 at both sides. In this embodiment, the first and second engaging members are in the form of cavities 32. When the first and second arm 13 of the plugs 10 are inserted into the socket 20 through the first and second opening 22, the first and second cavities 32 are capable of receiving the engaging portion 14 of the first and second arm 13 respectively. The cavity 32 is provided with a bulge 34 to define a side wall of the cavity 32.

The bulge 34 has a guide surface facing the opening 22. The engaging portion 14 of the arm 13 also has a corresponding guide surface. The engaging portion 14 is guided to enter into the cavity 32 through the guide surfaces of the bulge 34 and the engaging portion 14.

By the above arrangement, the cavity 32 may receive the engaging portion 14 of the arm 13 and the engaging portion 14 is engaged with the bulge 34, to thereby secure the plug 10 within the socket 20.

Figure 7:
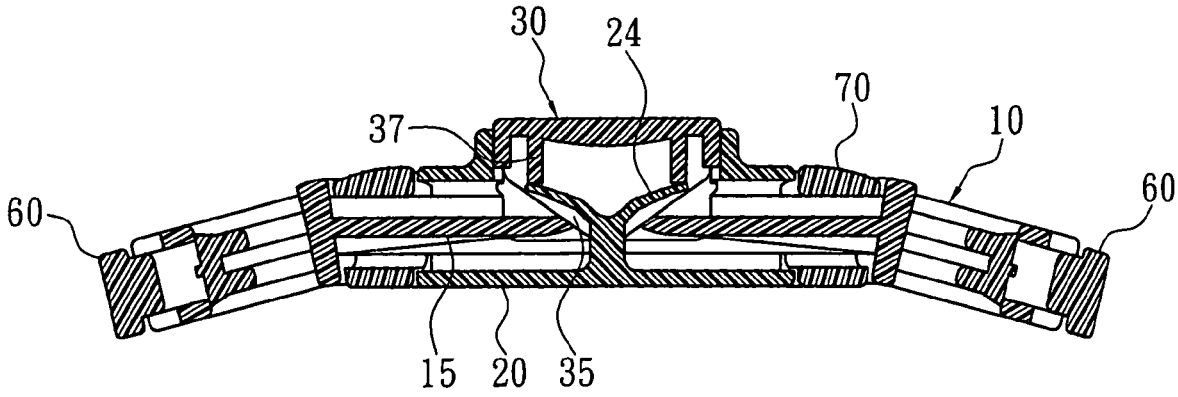
FIG. 7 is a cross-sectional view taken along line A-A of FIG. 2, showing the waist-strap being inserted into the socket.

Furthermore, the release button 30 has an inclined surface 35 and a post 37 between the first and second cavity 32. The inclined surface 35 is corresponded to the resilient tongue 15 and the post 37 is corresponded to the resilient member 24 of the socket 20. With reference to FIG. 7, when the release button 30 is pressed, the inclined surfaces 35 will exert a force on the resilient tongue 15 to eject the plug 10 from the socket 20. The functions of the post 37 and the resilient member 24 are to facilitate the restoration of the release button 30.

When the user intends to buckle up, the arm 13 and resilient tongue 15 of the plug 10 are first inserted into the slot 72 of the shoulder strap-coupling device 70, then into the opening 22 of the socket 20, and finally engaged with the release button 30 to secure the plug 10 within the socket 20. The engaging portion 14 of the arm 13 is engaged with the cavity 32 and the buckle device is in an engaging position. In the engaging position, the first and second plug for shoulder strap 70 are respectively arranged between the first plug 10 and socket 20, and between the second plug 10 and socket 20 and the inclined surface 35 of the release button 30 is abutted against the resilient tongue 15.

When it is desired to unlock the buckle device, the release button 30 is pressed and is moved from the locking position to an unlocking position. Upon pressing, the release button 30 will move downward to disengage the arms 13 of the plug 10 from the bulge 34 of the release button 30. Upon the pressing of the release button 30, the inclined surfaces 35 of the release button 30 will cooperate with the resilient tongue 15 of the plug 10 so as to eject the plug 10 from the socket 20.

By the above arrangement and operation, the plug 10 can be easily removed from the socket 20, and the buckle device is in a disengaging position.

Figure 8:
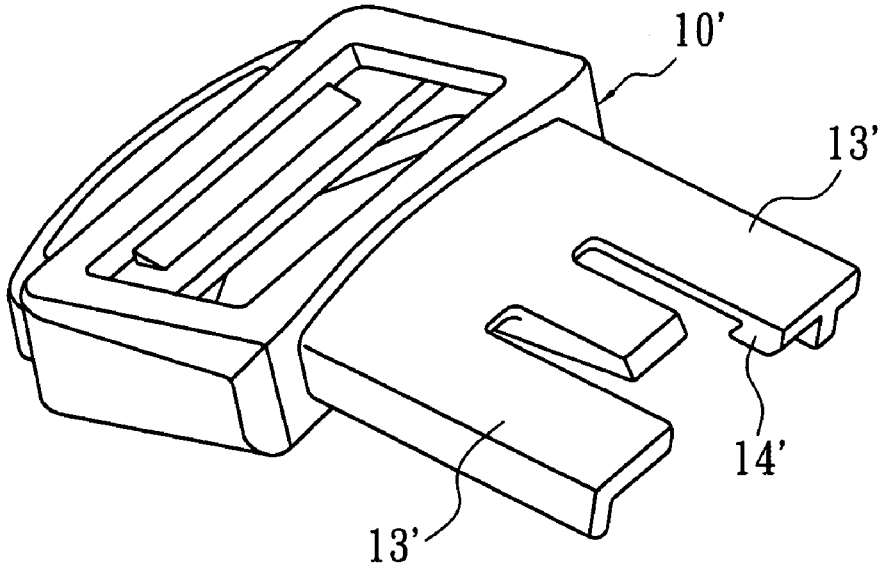
FIGS. 8 and 9 illustrate a further embodiment of the plug according to the present invention.
Figure 9:
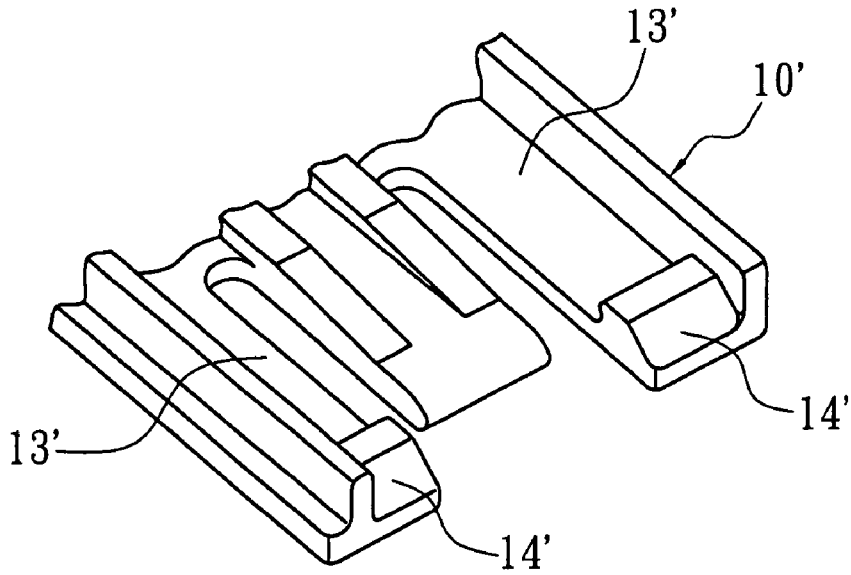

FIGS. 8 and 9 illustrate respectively the perspective view and the bottom view of a further embodiment of the plug according to the present invention. This further embodiment is different from the embodiment described hereinbefore in that the engaging portions 14' of the arms 13' of the plug 10' are extended downward and positioned underneath the arm 13'.

Although the foregoing has been described in terms of presently preferred and alternate embodiments, those skilled in the art will recognize that the invention is not limited to the embodiments described. The devices of the present invention can be practiced with modification and alteration within the spirit and scope of the appended claims. The description is thus to be regarded as illustrative instead of limiting the present invention.

I claim:

1. A buckle device comprising:

first and second plugs respectively coupled to waist-strap adjusting devices, each of the plugs including a strap-attaching portion connected to the respective waist-strap adjusting device, first and second arms extending from each strap-attaching portion;

a socket including first and second openings at opposite ends for respectively receiving the first and second arms of the first and second plugs, the socket having a hole formed in a top portion thereof and a resilient member mounted at a bottom portion; and a release button mounted in the opening of the socket, wherein the release button includes first and second engaging members at opposing sides thereof for respectively engaging with the first and second arms of the first and second plugs, when the first and second arms of the plugs are inserted into the socket through the first and second openings of the socket.

2. The buckle device according to claim 1, wherein a resilient tongue projecting from each of the strap-attaching portions is disposed between the first and second arm of each of the plugs and is adapted to be inserted into the socket; and the release button includes inclined surfaces corresponding to the resilient tongue between the first and second engaging members, and wherein when the release button is pressed, the inclined surfaces urge against the resilient tongues of the first and second plugs to eject the plugs.

3. The buckle device according to claim 1, wherein the resilient member is integrally formed on the socket.

4. The buckle device according to claim 1, wherein the resilient member has two resilient legs substantially forming a in a shape of "Y" shape to abut against the release button.

5. The buckle device according to claim 1, further comprising first and second shoulder strap-coupling devices, the first and second shoulder strap-coupling devices are respectively arranged between the first plug and the socket and between the second plug and the socket.

6. The buckle device according to claim 2, wherein the first and second arms each has an engaging portion disposed at a free end portion of the arms thereby forming first and second engaging portions, the first and second engaging portions being configured to be engaged with the first and second engaging members of the release button, respectively.

7. The buckle device according to claim 6, wherein the engaging portions extend perpendicularly to the arm to form a hook shape and the first and the second engaging members of the release button each include a cavity configured to receive the corresponding engaging portions of the arm.

8. The buckle device according to claim 7, wherein each of the engaging members is provided with a bulge to define a side wall of the cavity, and the bulges are configured to engage with the engaging portions of the arms of the first and second plugs, to thereby secure the plugs in the socket.

9. The buckle device according to claim 6, wherein each of the engaging members is provided with a bulge at one side, and the bulges are configured to engage with the engaging portions of the arms of the first and second plugs, to thereby secure the plugs in the socket.

10. A buckle device comprising:

a pair of first strap-coupling devices each respectively include a strap-attaching portion and first and second arms extending from the strap-attaching portion, a socket including a pair of openings at opposite sides thereof, a hole formed in a top portion thereof, and a resilient member integrally mounted at a bottom portion thereof, each opening being adapted to respectively receive the first and second arms of the first strap-coupling devices, a release button disposed within the hole of the socket and abutted against the resilient member, the release button being moved between a locking position where the first strap-coupling devices are secured to the socket, and an unlocking position where the first strap-coupling devices are removed from the socket, wherein the resilient member of the socket is biased against the release button to the locking position.

11. The buckle device according to claim 10, wherein the resilient member includes including two resilient legs substantially in the shape of a "Y".

12. The buckle device according to claim 11, wherein the release button further including two posts to abut against the resilient legs respectively.

13. The buckle device according to claim 10, wherein the buckle device further comprising a pair of second strap-coupling devices, each second strap-coupling device includes a slot to allow the first and the second arms of the corresponding first strap-coupling device to pass through.

14. A buckle device comprising:

a pair of first strap-coupling devices each respectively include a strap-attaching portion, first and second arms extending from the strap-attaching portion, and a resilient tongue disposed between the first and second arms of each of the first strap-coupling devices, a socket including includes a pair of openings at opposite sides thereof and a hole formed at a top portion thereof, each opening being adapted to receive the first arm, the second arm and the resilient tongue of a respective first strap-coupling device, and a release button disposed within the hole of the socket and including a pair of inclined surfaces corresponding to each resilient tongue, wherein the release button is biased moving between a locking position where the first strap-coupling devices are secured to the socket, and an unlocking position where the inclined surfaces urge against the corresponding resilient tongue of the first strap coupling devices to eject the first strap coupling devices form the socket, and wherein the buckle device further comprising a pair of second strap-coupling devices, each second strap-coupling device includes a slot to allow the first arm, the second arm and the resilient tongue of the corresponding first strap-coupling device to pass through.

15. The buckle device according to claim 14, wherein the resilient member is integrally formed on the socket.

16. The buckle device according to claim 14, wherein the resilient member has two resilient legs substantially in the shape of a "Y" to abut against the release button.

* * * * *